US006675452B2

(12) United States Patent
Smith

(10) Patent No.: US 6,675,452 B2
(45) Date of Patent: Jan. 13, 2004

(54) METHOD OF ENABLING THE NESTING OF METAL UNITS

(76) Inventor: Richard A. Smith, 608 S. Central Ave., Stafford, AZ (US) 85546

( * ) Notice: Subject to any disclaimer, the term of this patent is extended or adjusted under 35 U.S.C. 154(b) by 194 days.

(21) Appl. No.: 09/848,189

(22) Filed: May 2, 2001

(65) Prior Publication Data

US 2002/0005351 A1 Jan. 17, 2002

Related U.S. Application Data

(60) Provisional application No. 60/217,637, filed on Jul. 11, 2000.

(51) Int. Cl.[7] ..... B23P 23/00

(52) U.S. Cl. ..... 29/401.1; 414/790.2; 414/766; 204/292; 204/280

(58) Field of Search ..... 29/596, 598, 401.1, 29/592.1, 428, 469, 505, 554; 363/478.01; 700/213; 414/790.2, 790.4, 766; 204/292, 280

(56) References Cited

U.S. PATENT DOCUMENTS

| | | | | |
|---|---|---|---|---|
| 4,131,531 A | * | 12/1978 | Kaneko et al. | 204/208 |
| 5,793,637 A | * | 8/1998 | Clayton et al. | 700/213 |
| 5,918,359 A | * | 7/1999 | Neuenschwander | 29/564.2 |
| 5,992,003 A | * | 11/1999 | Elliott et al. | 29/596 |
| 6,139,974 A | * | 10/2000 | Atkinson et al. | 428/595 |
| 6,223,417 B1 | * | 5/2001 | Saban et al. | 29/598 |
| 6,276,044 B1 | * | 8/2001 | Ragland et al. | 29/521 |

* cited by examiner

*Primary Examiner*—John C. Hong
*Assistant Examiner*—Stephen Kenny
(74) *Attorney, Agent, or Firm*—Thrasher Associates, LLC

(57) ABSTRACT

The invention provides methods and devices that enable the nesting of metal units. One method generally identifies a nesting location on the metal unit, and applies a force at the nesting location to create a nesting feature. In another embodiment, the invention is a nestable metal sheet. The nestable metal sheet is generally a metal sheet, such as a copper cathode, having a nesting feature.

13 Claims, 1 Drawing Sheet

Figure 1
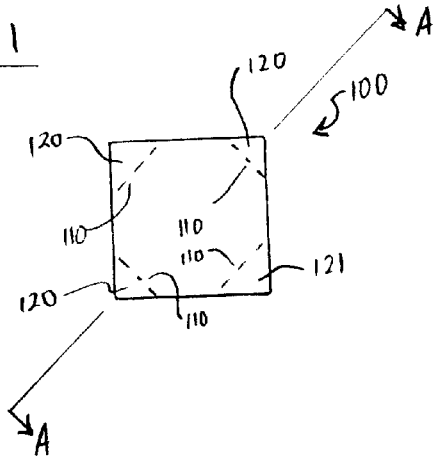
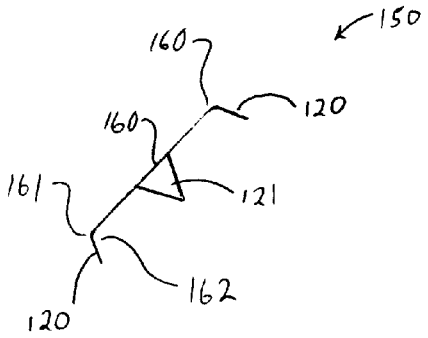
Fig. 2
Fig. 3
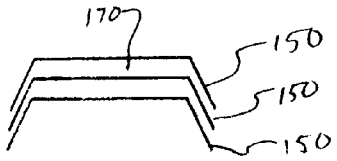
Fig. 4
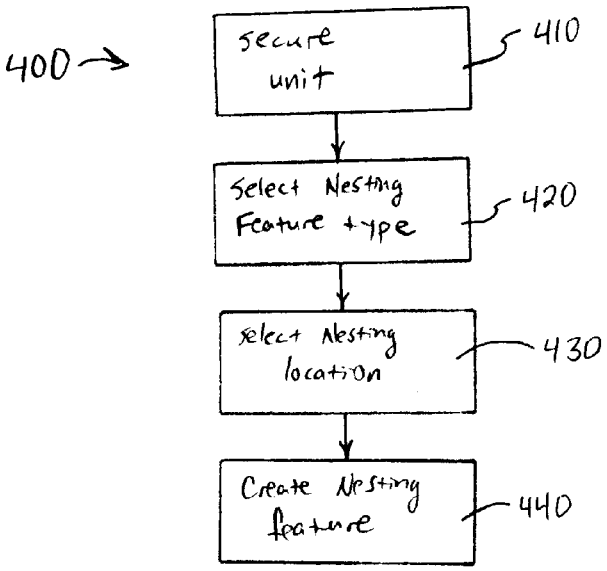

METHOD OF ENABLING THE NESTING OF METAL UNITS

CROSS REFERENCE TO RELATED APPLICATION

The invention is related to and claims priority from U.S. Provisional Patent Application No. 60/217,637, filed On Jul. 11, 2000, by Richard A. Smith, and entitled Cathode Nesting Press.

BACKGROUND OF THE INVENTION

1. Technical Field of the Invention

The invention relates generally to preparing metal units, such as metal plates, so that they will be immobilized when stacked. More specifically, the invention relates to preparing copper cathodes so that they may be stacked, and then moved or stored, without the use of a securing device, such as a metal band.

2. Problem Statement

Metal plates (also called sheets) are commonly used in industrial applications. For example, some copper metal sheets may be used as copper cathodes in mining operations. In addition, zinc metal sheets are used as anodes in industrial water applications to prevent the "pitting" of a metallic container.

Accordingly, in the mining industry, the copper cathodes are used in copper bearing solutions of sulfuric acid and water. More specifically, a copper leaching process called SXEW (solvent extraction/electrowinning) is used at most copper mines to extract copper from oxide ores by electrowinning copper our of solution. In practice, this process (called leaching) runs copper-containing acid and water through a pile or dump of copper bearing oxide ore, and collects the resulting solution for further processing. Another method of producing copper cathodes is by electrwinning copper from a smelter produced anode. This method takes the copper off of the anode and plates it onto a sheet (typically, either stainless steel or a very thin copper starter sheet) to produce a cathode. Accordingly, copper mining and many other industrial processes utilize a large number of metal plates.

Sometimes, due to size limitations, space needed in an industrial application, melting qualities, or other factors, a metallic rod is preferable to a metal plate. Accordingly, sometimes the word "metal unit" is used to describe a metal plate (metal sheet), metal rod, or any other type of stackable metallic processing pieces.

Bundling is the process of gathering and stacking metal units for transport or storage (thus creating a "bundle" of metal units). Although bundling may be interpreted by some to imply the application of a securing device to a bundle, as used herein, bundling means the association of two or more metal units, regardless of purpose. Typically, although not necessarily, the association is a stacking of the metal units.

Unfortunately, many metal units are destroyed or lost in transport between a manufacturing or storing site, and an industrial location that utilizes the metal units. This is because securing devices, such as metal bands, that are used to support metal units in transport are often insufficiently strong to withstand the forces and momentum generated by otherwise apparently static metal units. Accordingly, shearing and other forces often cause metal bands to break, or may cause a stack of metal units to fall over. Accordingly, many metal units fall off trucks, trains, or other transport vehicles. Furthermore, stacks of metal units may fall, or slide in a one-on-top-of-each-other fashion, and damage facilities or equipment. Therefore, it would be advantageous to have methods for bundling metal units that more securely maintains the metal units in a stack or other position.

SUMMARY OF THE INVENTION

The invention provides technical advantages as methods and devices that enable the nesting of metal units. In one embodiment, the invention is a method of modifying a metal unit to enable nesting. The method generally identifies a nesting location on the metal unit, and applies a force at the nesting location to create a nesting feature.

The method may also include selecting a nesting feature type—such as a dimple, a bubble, a bend along at least one side of the metal unit, an impression, or at least one bend along at least one corner of the metal unit. The metal unit may be a metal plate, such as a copper cathode, or a metal rod.

In another embodiment, the invention is a nestable metal sheet. The nestable metal sheet is generally a metal sheet, such as a copper cathode, having a nesting feature. The nesting feature may include a generally polygonal impression, a raised polygonal surface, or a bend along at least one corner of the metal sheet. Furthermore, the nestable metal sheet may include a separation feature for separating a first metal sheet from a second metal sheet.

In yet another embodiment, the invention is a nestable copper cathode for use in Sulfuric acid bearing solutions, comprising a nesting feature, the nesting feature comprising a bend along at least one corner of the nestable copper cathode. Of course, other features and embodiments of the invention will be readily apparent to those of ordinary skill in the art, and thus, similar results as described herein can be achieved in not dissimilar manners. Accordingly, the following discussion should not be read as limiting, and the scope of the invention should be read as limited only as defined in the CLAIMS.

DESCRIPTION OF FIGURES

The invention is best understood by reference to the following detailed description, which should be read in conjunction with the accompanying drawings, wherein:

FIG. 1 is a top down view of a metal unit;

FIG. 2 is a cut-view of the metal unit taken across the diagonal cut line AA;

FIG. 3. illustrates a plurality of nestable metal units that are nested (or bundled) together; and FIG. 4. illustrates a create nestable metal unit algorithm.

DETAILED DESCRIPTION

Figure 5:
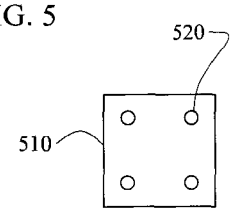

A nestable metal unit is a metal until that has features that enable the metal unit to be securely bundeled without the use of a securing device. Accordingly, the invention provides methods of modifying metal units, as well as metal units, which are nestable. In general, to create a nestable metal unit, a common nesting location is identified on a first metal unit (it is "common" in the sense that the other metal units that are nestable with the first metal unit will have a similar nesting feature at about the same location; furthermore, the metal units should include a complementary nesting feature—one that mates with the nesting feature—at a location that mates with the nesting location of the first metal unit). Then, a force is applied at the nesting location to create a nesting feature.

Accordingly, a nestable metal unit generally is a metal plate (or metal sheet) having a nesting feature at a common location. When using a nesting feature, metal units may be bundled by nesting such that a nestable feature of a first metal unit snuggly fits into a complementary nestable feature of a second metal unit. In practice, nesting metal plates secures the plates much more effectively than bundling the metal plates, and then tying the metal plates with a metal band. In fact, in some embodiments, the weight and size of a metal unit becomes an advantage because larger and heavier metal units will have more force pushing them together, and therefore nest more securely.

The invention may be better understood by way of an illustration. Accordingly, FIG. 1 is a top-down view of a metal unit 100. Although the metal unit illustrated in FIG. 1. appears as a plate (or sheet), it should be understood that the principals taught by the invention may be applied to any other shaped metal unit, including rods. In addition, the material from which the metal unit is made is generally unimportant. However, for purposes of this embodiment which is directed at the copper mining industry, the metal unit is preferably a copper cathode. In an alternative embodiment, the metal unit is a copper metal rod.

The metal unit 100 has a plurality of nesting locations 110 identified thereon. In the preferred embodiment, the nesting locations are lines made at each corner of the copper cathode, such that the line "cuts" the corner into an approximately isosceles triangle. Accordingly, each corner 120 of the copper cathode 100 may become a nesting portion of the metal unit, where a nesting portion is the structure that creates a nesting feature. A fourth corner 121 is distinguished from other corners 120 to clarify geometries illustrated in the second figure.

Accordingly, FIG. 2 is a cut-view of the metal unit 100 taken across the diagonal cut line AA. In FIG. 2, one may see that the basic shape of the metal unit 100 remains unchanged. However, at each nesting location 110, a nesting feature (namely a bend 160) has been produced.

Thus, as illustrated in FIG. 2, a preferred nesting feature is a bend. Accordingly, it may be seen that each bend 160 has an outside radius 161, and an inside radius 162 that is a different radius (smaller) than the inside radius 162. The disparity in radius size may be used as advantage of the invention, since the inside-outside radius differential creates a natural separation between the metal plates when the metal plates are stacked on top of each other. The space is typically about the width of the metal unit itself. Furthermore, the actual separation between the plates may be planned by adjusting the angles of the bends. In any event, metal plate separation enables the metal plates to be melted, or otherwise interact with their environment, more quickly than if the plates were merely stacked without separation. Among other benefits, this saves fuel and other energy cost.

It should be understood that many nesting features are possible. For example, one nesting feature may be created by "poking" a metal unit to create a dimple on one side of the cathode, and a bubble on the other side of the cathode. Other nesting features can be created by bending one side, two sides, or all four sides of the metal unit. Yet additional nesting features could be created by forming a polygonal impression on one side of a metal unit, and a corresponding raised polygonal structure on the other side of the metal unit. Similarly, another nesting feature may be built by creating a generally circular impression on one side of a metal unit, and a corresponding generally circular raised-structure on the second side of the metal until.

FIG. 4. illustrates a create nestable metal unit algorithm 400. The create nestable metal unit algorithm 400 begins with a secure unit act 410. In the secure unit act 410 the metal unit, irrespective of type, is securely positioned in a cathode nesting press. Then, in a select nesting feature type act 120 one may select the specific type of nesting feature they desire to apply to the metal unit. For example, one may choose to use dimples as a nesting feature. However, it is preferable that a single bend be made at a constant location at each corner of a metal unit.

This common location is selected in a select nesting location act 430. Preferably, on a copper cathode, the bend is located across each corner, approximately four inches from the corner. Of course, the selection of the nesting location will depend on the type of nesting feature one desires to use.

For example, should one choose to use a dimple nesting feature, it maybe more advantageous to select three nesting locations for each metal unit such that the nesting locations form the points of an equilateral triangle, centered about the center of the metal unit. Then, following the select nesting location act 430, the create nestable metal unit algorithm 400 proceeds to a create nesting feature act 440. In the create nesting feature act 440 the cathode nesting press is activated and the appropriate nesting feature is created in the metal unit. So, for example, if a "bend" nesting feature is desired, the cathode nesting press will bend the metal unit in the nesting location in the create nesting feature act 440. Alternatively, if a dimple is selected as the nesting feature the cathode nesting press will create the dimple(s) at the desired nesting location(s) in the create nesting feature act 440.

Of course, it should be understood that the order of the acts discussed in the create nestable unit algorithm 400 may be accomplished in different orders depending on the preferences of those skilled in the art. In addition, though the background section describes specific applications of copper anodes, such as copper leaching and electrwinning copper from a smelter produced anode, it should be understood that this is done for exemplary purposes only, and that the invention is in no way limited to the specific application of the method of anode production. Furthermore, it should be understood that the above discussion is merely a description of an embodiment, and that the invention is limited only by the following claims.

I claim:

1. A method of modifying a metal unit derived from an electrowinning process to adapt the metal unit for transport and to enable the nesting of a plurality of metal units, comprising:

securing a metal unit created from an electrowinning process (the electrowon metal unit);

identifying a nesting location on the ekectrowon metal unit; and applying a force at the nesting location to create a nesting feature at at least two corners of said metal unit, wherein said nesting feature comprises folding a diagonal portion of the electrowon metal unit.

2. The method of claim 1 further comprising securing the metal unit.

3. The method of claim 1 further comprising selecting a nesting feature type.

4. The method of claim 1 wherein the nesting location is a nesting line.

5. The method of claim 1 wherein the metal nesting feature is a dimple.

6. The method of claim 1 wherein the metal nesting feature is a bubble.

7. The method of claim 4 wherein the metal nesting feature is a band along at least one side of the metal unit.

8. The method of claim 4 wherein the metal nesting feature comprises at least one bend along at least one corner of the metal unit.

9. The method of claim 1 wherein metal unit is a metal plate.

10. The method of claim 1 wherein the metal unit is a metal rod.

11. The method of claim 1 wherein the metal unit is a copper cathode.

12. The method of claim 1 wherein the nesting feature is a generally polygonal impression.

13. The method of claim 1 wherein the nesting feature is a generally circular impression.

* * * * *

UNITED STATES PATENT AND TRADEMARK OFFICE

CERTIFICATE OF CORRECTION

PATENT NO. : 6,675,452 B2
DATED : August 3, 2004
INVENTOR(S) : Smith, Richard

Figure 6:
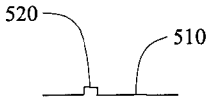
Figure 7:
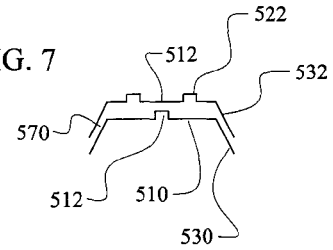
Figure 8:
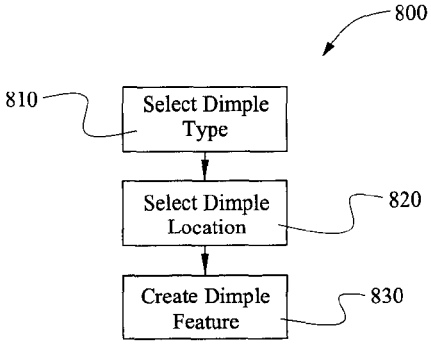

It is certified that error appears in the above-identified patent and that said Letters Patent is hereby corrected as shown below:

Drawings,
Please replace the drawings in the patent with the attached new drawings Sheets 1 and 2 consisting of Figs. 1 - 8.

Signed and Sealed this

Ninth Day of November, 2004

FIG. 1
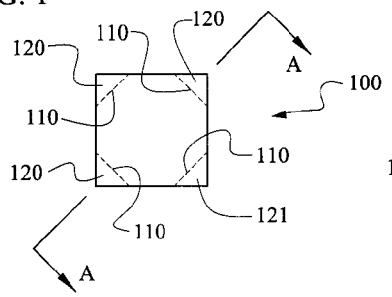
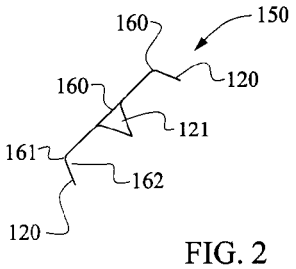
FIG. 2
FIG. 3
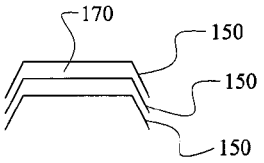
FIG. 4
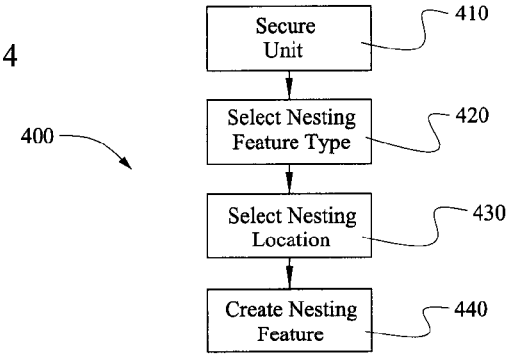

JON W. DUDAS
*Director of the United States Patent and Trademark Office*